United States Patent [19]

Fröling et al.

[11] 4,399,007

[45] * Aug. 16, 1983

[54] HYDROGENATION

[75] Inventors: Albert Fröling, Vlaardingen; Rudolph O. de Jongh, The Hague; Josephus M. A. Kemps, Udenhout, all of Netherlands

[73] Assignee: Lever Brothers Company, New York, N.Y.

[ * ] Notice: The portion of the term of this patent subsequent to Apr. 27, 1999, has been disclaimed.

[21] Appl. No.: 274,578

[22] Filed: Jun. 17, 1981

Related U.S. Application Data

[63] Continuation of Ser. No. 2,048, Jan. 8, 1979, Pat. No. 4,326,932, which is a continuation of Ser. No. 866,147, Dec. 30, 1977, abandoned.

[30] Foreign Application Priority Data

Dec. 31, 1976 [GB] United Kingdom ..... 54485/76

[51] Int. Cl.[3] ..... C25B 3/04; C11C 3/12

[52] U.S. Cl. ..... 204/59 R; 204/73 R

[58] Field of Search ..... 204/59 R, 73 R, 76

[56] References Cited

U.S. PATENT DOCUMENTS

| | | | |
|---|---|---|---|
| 2,147,177 | 2/1939 | Seto et al. | 204/73 R |
| 2,724,689 | 11/1955 | Dunmire et al. | 204/167 |
| 3,779,875 | 12/1973 | Michelet | 204/7 L |
| 3,865,853 | 2/1975 | Hinze | 252/430 X |
| 3,925,173 | 12/1975 | Junghans | 204/73 R |

FOREIGN PATENT DOCUMENTS

| | | | |
|---|---|---|---|
| 203817 | 10/1955 | Australia | 204/76 |
| 189332 | 10/1907 | Fed. Rep. of Germany | 204/76 |
| 1205539 | 11/1965 | Fed. Rep. of Germany . | |
| 786008 | 8/1935 | France . | |
| 1025125 | 4/1953 | France . | |
| 2169216 | 12/1973 | France . | |
| 7300978 | 7/1973 | Netherlands . | |
| 385273 | 1/1933 | United Kingdom . | |
| 550356 | 1/1943 | United Kingdom . | |

*Primary Examiner*—F. Edmundson

[57] ABSTRACT

Process for the selective hydrogenation of polyunsaturated compounds with a metallic catalyst. The selectivity is increased and trans-isomerization is decreased by carrying out the hydrogenation in the presence of a catalyst to which, before the hydrogenation is started, an external potential, differing from the naturally occurring equilibrium potential, is applied while in contact with an electrolyte, such as a quaternary ammonium salt, dissolved in a liquid, such as an alcohol or a ketone.

23 Claims, 5 Drawing Figures

HYDROGENATION

Figure 1:
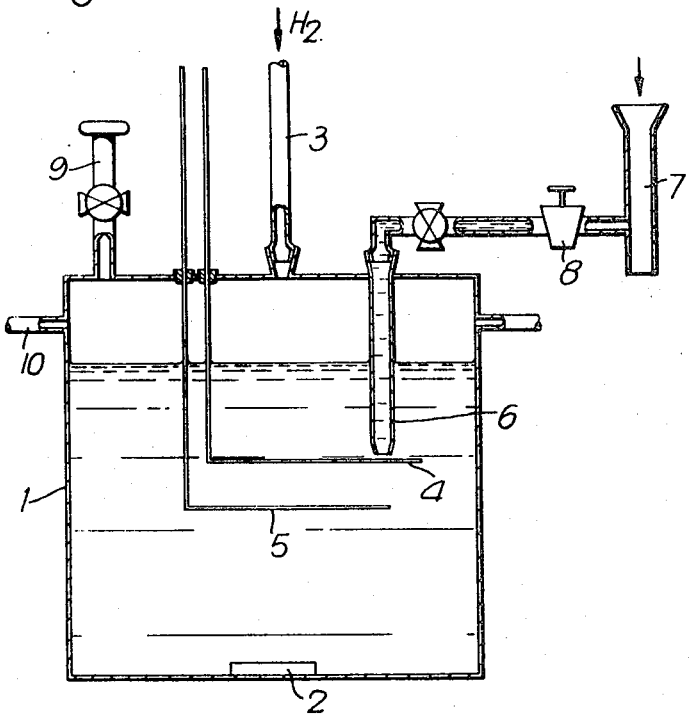

This application is a continuation of co-pending application filed Jan. 8, 1979, Ser. No. 2,048, now U.S. Pat. No. 4,326,932, which in turn is a continuation of application Ser. No. 866,147, filed Dec. 30, 1977, now abandoned.

The invention relates to a process for the selective hydrogenation of poly-unsaturated compounds, in particular poly-unsaturated fatty acid esters, especially their triglycerides.

As is generally known, oils and fats consist substantially of a mixture of triglycerides of fatty acids. The fatty acids usually contain about 16 to about 22 carbon atoms and can be saturated, such as stearic acid; mono-saturated, such as oleic acid; di-unsaturated, such as linoleic acid or tri-unsaturated, such as linolenic acid, or even show a higher unsaturation.

In the art of oil and fat technology it is customary to hydrogenate oils to remove part of the unsaturation and thereby give the hydrogenated oil desired properties, like higher melting point and/or increased stability.

During the hydrogenation a number of reactions occur, both consecutively and concurrently. For instance, for the hydrogenation of linolenic acid the hydrogenation can be represented by the following simplified scheme:

$$\text{linolenic acid} \xrightarrow{K_1} \text{linoleic acid} \xrightarrow{K_2} \text{oleic acid} \xrightarrow{K_3} \text{stearic acid,}$$

in which $K_1$, $K_2$, etc. designate the rate constants of the reactions involved. Moreover, side reactions occur, such as displacement and isomerisation of double bonds. Isomerisation leads to conversion of cis double bonds to trans double bonds, the corresponding oils containing the trans acids usually have a higher melting point. Oils and fats containing a high amount of stearic acid have too high a melting point to be organoleptically acceptable for most applications. Therefore, in the past it was customary to direct the hydrogenation in such a way that as little stearic acid as possible was formed and a high amount of trans oleic acid was obtained to give the oil the desired melting point. Nowadays, the cis-trans isomerisation is considered less desirable because there is a shift to liquid but stable oils which are applied as such or as ingredient for soft margarines which are stored in refrigerators.

The selectivities in the hydrogenation reactions are usually defined as follows:

$$S_I = K_2/K_3$$

$$S_{II} = K_1/K_2$$

When $S_I$ of the reaction is high, low amounts of saturated acids are produced. When $S_{II}$ of the reaction is high it is possible to hydrogenate linolenic acid, while maintaining a high percentage of the essential fatty acid: linoleic acid. $S_i$ is defined as the amount of trans-isomers formed in relation to the hydrogenation degree. As has been said, nowadays one wishes to direct the hydrogenation in such a way that $S_i$ has as low a value as possible.

However, in normal practice of hydrogenation, which is usually carried out with the aid of a nickel catalyst supported on a carrier, at high temperatures and elevated pressures, substantial isomerisation of double bonds cannot be avoided.

Some catalysts have been proposed as being more selective, for instance copper catalysts. However, such catalysts, though being more selective, give about the same degree of isomerisation as nickel.

It has now been found that the course of the reactions occurring during the hydrogenation with the aid of a metallic catalyst can be influenced by carrying out the hydrogenation in the presence of a catalyst to which before the hydrogenation is started an external electric potential which is different from the naturally occurring equilibrium potential, is applied while in contact with an electrolyte dissolved in a liquid.

Said potential has such a value that no electrochemical hydrogen production takes place. The new process is therefore to be distinguished from electrochemical hydrogenations, in which the hydrogen needed for the hydrogenation is produced by electrochemical conversion of, for instance, water or an acid.

The same catalyst can be used over and over again, both without and with an external potential or at different potentials.

The invention is not restricted by any theoretical explanation of the phenomena occurring at the catalyst surface.

In carrying out the process of the invention the substance to be hydrogenated is preferably dissolved or dispersed in a liquid, such as an alcohol or a ketone. The liquid used should preferably not react with hydrogen in the presence of the catalyst and under the reaction conditions used. Water, methanol, ethanol, isopropanol, glycerol, acetone, methyl cellosolve, acetonitrile, hexane, benzene, and mixtures thereof can be used. However, when an alcohol is used as the liquid sometimes some alcoholysis may occur. It is not essential that the substance to be hydrogenated (substrate) be soluble in the liquid chosen. Dispersions of, for instance, a triglyceride oil in methanol have given equally good results as solutions of the oil in acetone or in an acetone-methanol mixture.

The ratio of liquid to substrate is not critical. Preferably ratios of about 20:1 to about 1:1 or even lower are used. An amount to dissolve the electrolyte is already sufficient. It has been found that in more concentrated systems the selectivity is usually higher.

The system should possess some electric conductivity. To that end an electrolyte can be added to the system. As electrolyte a substance should be chosen which does not react with hydrogen. Furthermore the electrolyte should be sufficiently soluble in the liquid chosen and should not react with the substrate under the reaction conditions employed. Good results have been obtained with quaternary ammonium salts, such as tetraethyl ammoniumperchlorate, tetrabutyl ammonium perchlorate, tetraethyl ammonium phosphate, tetraethyl ammoniumbromide, tetraethyl ammonium para toluene sulphonate, tetramethyl ammonium acetate, and further with sodium dodecyl-6-sulphonate, sodium acetate, sodium hydroxide, sodium methanolate and ammonium acetate. The amount of electrolyte used is not critical, and usually a concentration in the range of about 0.001 M to about 0.1 M is sufficient.

The process according to the invention is not sensitive to the presence of water. Systems containing up to 10% of water gave good hydrogenation results. Hence the above-mentioned liquids, electrolytes and other components of the system do not need to be moisture-free.

As the catalyst, any metallic catalyst can be used, like palladium, platinum, rhodium, ruthenium, nickel, etc. and their alloys. Such catalysts can take the form of an extracted alloy, such as Raney nickel. The catalyst can be used in the form of porous metal black supported on a sheet, which is immersed in the system, or preferably be in the form of small particles suspended in the system. In the latter case the metallic component is preferably supported on a carrier. For instance metals, ion-exchange resins, carbon black, graphite and silica may be used as the catalyst carrier.

To the catalyst an electric potential is applied via an inert electrode which is part of a three-electrode system, consisting of a working electrode, a counter electrode and a reference electrode. The potential on the working electrode can be controlled with respect to the reference electrode with the aid of a potentiostat, or a direct current power supply, which allows the potential to be kept constant at any desired value during hydrogenation. However, control via the cell voltage in a two-electrode system is also possible.

In general, potentials on the working electrode are defined and can be measured with respect to the reference electrode. The liquid junction between the electrolyte solution of the reaction mixture and the solution of the reference electrode can be achieved by any means characterised by a low electric resistance as well as a low liquid passage, such as a diaphragm tip near the surface of the working electrode or a Luggin capillary system known in the art of electrochemistry.

Working electrode and counter electrode may be separated from each other by any suitable means enabling the passage of current, such as a glassfrit.

The working electrode may be constructed from any material, preferably from a sheet of platinum or from platinium or stainless steel gauze, the counter electrode may consist of platinum or stainless steel and the reference electrode may be any reference electrode such as a saturated calomel electrode or a silver/silver chloride electrode.

The potential is transferred from the working electrode to the catalyst either by direct contact, as for instance with a palladized sheet of platinum (palladium being the catalyst) or by bringing the catalyst particles into contact with said electrode by vigorous stirring. Such so-called slurry electrodes are known in the art. Reference may be made to P. Boutry, O. Bloch and J. C. Balanceanu, Comp. Rend. 254, 2583 (1962).

It is also possible to enhance the potential transfer by adding a solid electrical conductive powder, like for instance aluminium powder, to the system, especially when a slurry electrode is used.

The potential applied depends on the nature of the catalyst and the solvent used. It can easily be established which potential should be applied to obtain the desired selectivity. For instance, for a palladium catalyst in methanol the formation of saturated fatty acids is completely suppressed upon maintaining a potential of −0.9 V vs SCE (versus a saturated calomel electrode).

In general the external potential applied will lie between CV vs SCE and −3 V vs SCE.

Though, as had been said above, application of a constant potential is preferred, an increased selectivity of the hydrogenation reaction is also achieved when the potential varies during hydrogenation. Sometimes it is even possible to apply a potential to the catalyst and then to switch off the power supply or potentiostat, if used. In that case the potential on the catalyst will initially drop, however, the rest potential staying on the catalyst will often be sufficient to give an increased selectivity and suppression of trans-formation.

To start the hydrogenation the potential can be applied to the working electrode after the apparatus has been filled with solvent containing the electrolyte, the catalyst has been added, and while the apparatus contains a hydrogen atmosphere. After the potential has been applied for a certain time the substance to be hydrogenated is brought into the apparatus.

Alternatively, the apparatus can be filled with liquid containing the electrolyte, the catalyst and the substance to be hydrogenated, and the apparatus be filled with nitrogen. Then the desired potential is applied to the working electrode for a certain time. The hydrogenation is started by replacing the nitrogen by hydrogen. In general the latter starting procedure is more practical and the selectivity of the hydrogenation reaction is somewhat better than when the first starting procedure is applied.

In a third method the potential is applied for a certain time to the liquid containing the electrolyte and suspended catalyst in an apparatus filled with hydrogen or nitrogen. Then the mixture is transferred to a reactor containing the substrate to be hydrogenated, which may be dissolved or dispersed in the same or another liquid.

The temperature at which the hydrogenation is carried out is not critical and will depend on the activity of the catalyst chosen. For palladium, platinum, etc., reaction rates are sufficient at room temperature, though lower and higher temperatures can be used. For less active catalysts, the use of higher temperatures of up to 100° C. or even higher may be necessary. In general, the temperature can lie in the range of −20° C. to 200° C. Also the reaction may be carried out at atmospheric pressure or at higher pressures or even below atmospheric pressure; in general the pressure will lie between 1 and 25 atm. Of course pressures above atmospheric are needed if one wishes to operate at a temperature above the boiling point of the liquid.

The process of the invention can be applied for the hydrogenation of compounds containing more than one double bond, to increase the selectivity of the hydrogenation reaction. As examples can be mentioned triglyceride oils, such as soyabean oil, linseed oil, fish oils, palm oil, etc., esters of fatty acids such as the methyl, ethyl and other alkyl esters, soaps, alcohols and other fatty acid derivatives, and poly-unsaturated cyclic compounds, like cyclododecatriene.

The invention is further illustrated but not restricted by the following Examples. In the Examples, in which the proportions of the components do not add up to 100%, the less relevant components like C14, C17, C20, C22 etc. fatty acids, are not mentioned. Said percentages are expressed as mole %. Other percentages are by weight.

In the tables the fatty acids are designated by the number of carbon atoms and the number of double bonds they contain, viz. C18:3 means linolenic acid, C18:2 linoleic acid, etc.

EXAMPLE I

The hydrogenation was performed under atmospheric pressure and at room temperature in an apparatus as depicted in FIG. 1. Herein (1) is a vessel with a content of 100 ml, equipped with a magnetic stirrer (2), an inlet for hydrogen (3), two platinum sheet electrodes with a surface of 5.5 $cm^2$, one being palladized and used as the catalyst (4) and the other (5) serving as counter-electrode, a Luggin capillary (6), leading to an aqueous saturated calomel reference electrode (7), saturated with sodium chloride, through a liquid junction formed in a closed tap (8), and a combination of a tap plus cap (9), enabling addition and withdrawing of liquids with a syringe. Flask and cover were connected by a wide flange (10). The reactor was connected with a 200 ml calibrated burette filled with hydrogen (purified over BTS-catalyst and $CaCl_2$) and paraffin oil. Controlled potentials were supplied by a potentiostat (ex Chemicals Electronics Co., Durham, England). Catalyst potentials were measured with respect to the reference electrode with a Philips PM 2440 vacuum tube voltmeter.

After charging the reactor and the Luggin capillary (up to the tap) with a 0.1 N solution of tetrabutylammonium perchlorate in absolute ethanol (in the reactor approximately 80 ml), the reactor was repeatedly evacuated and purged with hydrogen, after which the solution and the catalyst were saturated with hydrogen from the burette while stirring. The potential was measured, reaching a value of −0.32 V vs SCE in the equilibrium state.

Then 0.641 g (2.18 mmole) methyl linoleate (M=294.5) was added to the solution and stirring continued. The composition of the reaction mixture was determined by GLC both after uptake of 51.7 ml hydrogen (necessary for the hydrogenation of one double bond, viz. 100 mol. %) and after the linoleate content was diminished to 2%.

In this run no external potential was applied.

The experiment was repeated and this time an external potential of −1.10 V vs SCE was applied. This time 0.669 g (2.27 mmole) methyl linoleate was introduced into the reaction vessel, requiring 55.2 ml hydrogen per double bond. During this experiment a small current passed through the system amounting to the electrochemical equivalent of about 0.5% of the available double bonds.

The results are summarized in Table 1, in which compositions are given in mole %.

TABLE 1

| ∅ (V vs SCE) | Linoleate | Monoenic ester | Stearate | $H_2$ uptake (mole %) |
|---|---|---|---|---|
| No external potential applied | 2 | 14 | 84 | 187 |
| −1.10 | 2 | 93 | 3 | 102 |
| No external potential applied | 36 | 32 | 32 | 100 |
| −1.10 | 6 | 92 | 2.5 | 100 |

A bare sheet did not give any hydrogenation at all, which shows that the applied potential only has effect when a catalytic active substance is present.

EXAMPLE II

Example I was repeated with the exception that methyloleate was hydrogenated. Without an external potential the oleate ester was completely hydrogenated to methyl stearate. With an external potential of −1.10 V vs SCE hardly any hydrogen was taken up and oleate remained unconverted. No methyl stearate was detectable by GLC even after four hours reaction. Neither were any trans isomers formed.

EXAMPLE III

Example I was repeated with the exception that methyl linolenate was introduced into the reaction vessel instead of methyl linoleate, and that a potential of −0.90 V vs SCE instead of −1.10 V vs SCE was applied.

The results are summarized in Table 2.

TABLE 2

| ∅ (V vs SCE) | Linolenate | Dienoic ester | Monoenic ester | Stearate | $H_2$ uptake (mole %) |
|---|---|---|---|---|---|
| No external potential applied | 2 | 4 | 31.5 | 61 | 262 |
| −0.90 | 2 | 43 | 53 | 1.5 | 170 |
| No external potential applied | 52.5 | 6 | 29 | 13 | 100 |
| −0.90 | 34 | 36.5 | 26.5 | 0.5 | 100 |

The above Examples I to III show that applying a potential to the catalyst has a very strong influence on the selectivity. The formation of saturated compounds is suppressed, implying a very high selectivity $S_I$, while $S_{II}$ is also raised considerably, which follows from the high dienoic ester content.

EXAMPLE IV

In the same way as described in Example I methyl linolenate was hydrogenated using as catalyst palladium black and platinum black. The composition of the reaction mixture was determined after 95% of the linolenate was converted. The results are summarized in Table 3.

TABLE 3

| Catalyst | ∅ (V vs SCE) | Linolenate | Dienoic ester | Monoenic ester | Stearate |
|---|---|---|---|---|---|
| Pt | No potential applied | 5 | 7 | 12.5 | 75 |
| | −0.60 | 5 | 32.5 | 39 | 23.5 |
| Pd | No potential applied | 5 | 5.5 | 36 | 53 |
| | −0.90 | 5 | 45 | 47.5 | 1 |

EXAMPLES V, VI AND VII

Figure 2:
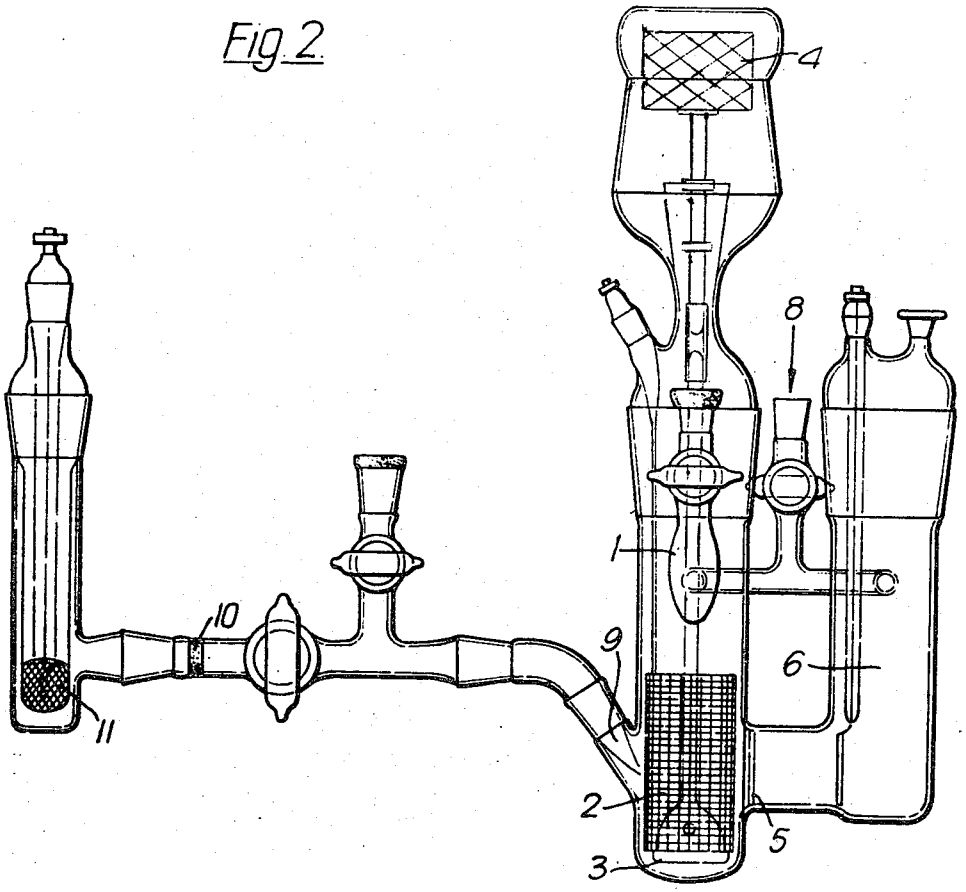

These Examples were carried out with a slurry electrode in an apparatus as depicted in FIG. 2. In FIG. 2, (1) is the cathode compartment, containing a platinum gauze (2) serving as the working electrode, and a bell-stirrer (3), driven via a magnet (4). The cathode compartment is connected via a medium frit (5) to the anode compartment (6) containing a platinum sheet (7) as counter electrode. Hydrogen is supplied through inlet (8). A Luggin capillary (9) leads through a medium frit (10) to a saturated calomel reference electrode (11), saturated with an aqueous saturated sodium chloride solution.

In this apparatus methyl linoleate was hydrogenated using as catalyst palladium powder, Raney nickel and palladium on carbon containing 5% palladium, both with and, for comparison, without an externally applied potential.

The reaction medium consisted of 0.05 M tetraethyl ammonium perchlorate in methanol. The potential was controlled as described in Example I. The composition of the reaction mixture was determined after 90% of the methyl linoleate was converted.

The results are summarized in Table 4.

TABLE 4

| Example | Catalyst | Ø (V vs SCE) | L* | M* | S* | $H_2$ uptake in mole % | Hydrogenation time in min. |
|---|---|---|---|---|---|---|---|
| V | Pd powder | No pot. applied | 10 | 82 | 8 | 97 | 37 |
| | Pd powder | −0.9 | 10 | 90 | — | 85 | 40 |
| VI | Raney nickel | No pot. applied | 10 | 87 | 3 | 90 | 70 |
| | Raney nickel | −0.3 | 10 | 89.5 | 0.5 | 90 | 53 |
| VII | 5% Pd-on-carbon | No pot. applied | 10 | 82 | 8 | 97 | 28 |
| | 5% Pd-on-carbon | −0.9 | 10 | 90 | — | 88 | 33 |

*L = linoleate; M = monoenic ester, S = stearate

These Examples also show the increase in selectivity of the hydrogenation reaction by the application of a potential to the catalyst surface, in that the formation of stearate is suppressed.

EXAMPLE VIII

In an apparatus as described in Examples V–VII, about 4 grams of soyabean oil were hydrogenated with and without an externally applied potential of −0.9 V vs SCE. The oil was dissolved in a 0.05 M solution of tetraethyl ammonium perchlorate in acetone in a ratio oil:liquid of 1:2. To the system was added 1% of palladium powder calculated on the oil. The hydrogenation was carried out at room temperature and under atmospheric pressure.

The results are summarized in Table 5.

TABLE 5

| Fatty acid | Composition of starting oil (%) | Composition of hydrogenated product (%): without an external potential applied | with an external potential applied of −0.9V vs SCE |
|---|---|---|---|
| C 18:3 | 7 | 2 | 2 |
| C 18:2 | 53 | 41 | 48 |
| C 18:1 | 24 | 40 | 34 |
| C 18:0 | 4 | 4 | 4 |
| C 16:0 | 12 | 12 | 12 |
| Total trans content (%) | 0 | 14 | 10 |
| $H_2$—consumption (ml/g oil) | — | 15.6 | 14.0 |
| Hydrogenation time (min.) | — | 116 | 160 |

This experiment shows the high selectivity $S_{II}$ and the low amount of trans-isomers formed during the hydrogenation when applying an external potential according to the invention.

EXAMPLE IX

Example VIII was repeated with the exception that methanol was used as the liquid in a ratio oil:solvent of about 1:4 and the amount of palladium powder was 2.5%. Since soyabean oil is poorly soluble in methanol a two-phase system results as opposed to the one-phase system of Example VIII.

The results are summarized in Table 6.

TABLE 6

| Fatty acid | Composition of starting oil (%) | Composition of hydrogenated product (%): without an external potential applied | | with an external potential applied of −0.9V vs SCE | |
|---|---|---|---|---|---|
| C 18:3 | 8 | 3 | 0 | 3 | 0 |
| C 18:2 | 53 | 35 | 16 | 52 | 35 |
| C 18:1 | 25 | 46 | 67 | 31 | 51 |
| C 18:0 | 4 | 6 | 7 | 4 | 4 |
| C 16:0 | 10 | 10 | 10 | 10 | 10 |
| Total trans content (%) | 0 | 13 | 27 | 4 | 12 |
| $H_2$—consumption (ml/g oil) | — | 19.3 | 37.0 | 4.7 | 20.5 |
| Hydrogenation time (min.) | — | 35 | 69 | 15 | 68 |

EXAMPLE X

Example IX was repeated, with a ratio of the amounts of oil to liquid of 1:4. The hydrogenation was continued until the oil had an iodine value of about 110.

The results are summarized in Table 7.

TABLE 7

| Fatty acid | Composition of starting oil (%) | Composition of hydrogenated product (%): without an external potential applied | with an external potential applied of −0.9V vs SCE |
|---|---|---|---|
| C 18:3 | 8 | 2 | 1 |
| C 18:2 | 53 | 31 | 35 |
| C 18:1 | 25 | 52 | 50 |
| C 18:0 | 4 | 5 | 4 |
| C 16:0 | 10 | 10 | 10 |
| Total trans content (%) | 0 | 18 | 8 |
| Melting point (°C.) | — | 20 | <0 |
| Iodine value | 133 | 115 | 118 |
| $H_2$—consumption (ml/g oil) | — | 24.6 | 24.6 |
| Hydrogenation time (min.) | — | 25 | 140 |

The experiment shows that the amount of trans acids formed is very low and that the melting point of the product is decreased by potential control.

EXAMPLE XI

Example VIII was repeated, using as the solvent acetone containing 0.05 M tetraethyl ammonium perchlorate. The oil:liquid ratio was 1:6 and the system contained 10% Raney nickel as the catalyst.

The results are summarized in Table 8.

TABLE 8

| Fatty acid | Composition of starting oil (%) | Composition of hydrogenated product (%): without an external potential applied | with an external potential applied of −1.5V vs SCE |
|---|---|---|---|
| C 18:3 | 7 | 2 | 2 |
| C 18:2 | 53 | 26 | 45 |
| C 18:1 | 24 | 52 | 37 |
| C 18:0 | 4 | 8 | 5 |

TABLE 8-continued

| Fatty acid | Composition of starting oil (%) | Composition of hydrogenated product (%) without an external potential applied | with an external potential applied of −1.5V vs SCE |
|---|---|---|---|
| C 16:0 | 12 | 12 | 12 |
| Total trans content (%) | 0 | 13 | 7 |
| $H_2$—consumption (ml/g oil) | — | 33.0 | 24 |
| Hydrogenation time (min.) | — | 55 | 200 |

This Example shows that also with Raney nickel as the catalyst, the selectivity of the hydrogenation is increased and the amount of trans-isomers formed is drastically reduced by the external potential.

EXAMPLE XII

Figure 3:
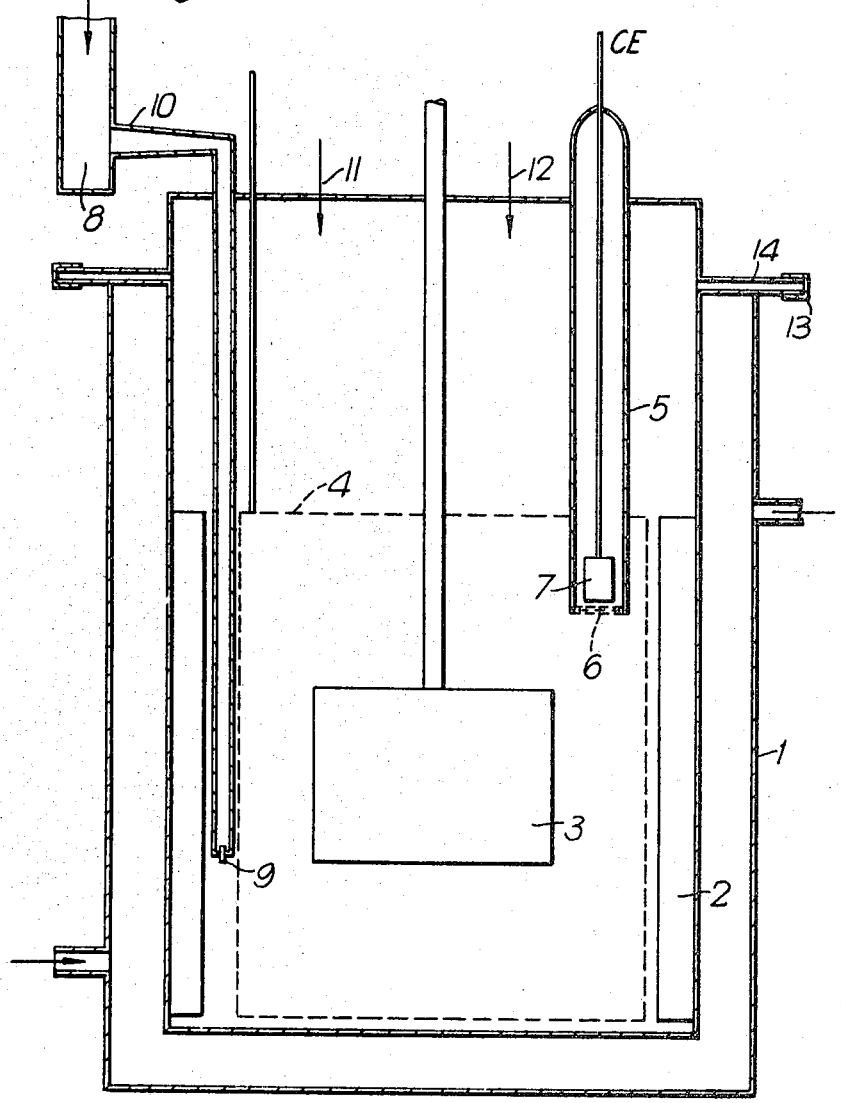

The apparatus according to FIG. 3 consists of a double-walled vessel with a capacity of 600 ml (1), through the jacket of which thermostated water can flow. The vessel is provided with four baffles (2) and a stirrer (3). The vessel further contains a stainless steel gauze (4) serving as the working electrode, a counterelectrode compartment (5), connected with the working electrode compartment through a glass frit (6) and containing a stainless steel or platinum counterelectrode (7). The counterelectrode compartment has an open connection with the headspace of the vessel (1) for pressure equalisation. A saturated calomel reference electrode (8) is contacted with the working electrode compartment through a ceramic diaphragm (9) and a salt bridge (10). The cover of the vessel is provided with inlets for oil (11) and for hydrogen (12). Said cover is fastened to the vessel during hydrogenation by means of a suitable clamping device (13) over the flanges (14).

In this apparatus 90 g soyabean oil were hydrogenated at 24° C. and under atmospheric pressure, applying an external potential of −0.95 V vs SCE and while stirring with 850 rpm. Acetone was used as the liquid in a volume ratio of oil to liquid of 1:4.5. The electrolyte was tetraethyl ammonium perchlorate (TEAP), used in different concentrations. The catalyst was palladium powder in an amount of 1.4%.

The results are summarized in Table 9.

TABLE 9

| Fatty acid | Composition of starting oil (%) | Composition of hydrogenated product (%) at a TEAP concentration of: 0.05 M | 0.02 M | 0.005 M | No external potential applied at 0.05 M TEAP |
|---|---|---|---|---|---|
| C 18:3 | 7 | 2 | 2 | 2 | 2 |
| C 18:2 | 55 | 45 | 45 | 45 | 33 |
| C 18:1 | 22 | 36 | 36 | 35 | 49 |
| C 18:0 | 4 | 4 | 4 | 4 | 5 |
| C 16:0 | 11 | 11 | 12 | 11 | 11 |
| Total trans content (%) | <1 | 8 | 8 | 9 | 16 |
| Hydrogenation time (min) | — | 40 | 43 | 39 | 21 |

This Example shows that the electrolyte concentration has hardly any influence on the result of the hydrogenation.

EXAMPLE XIII

Rape seed oil was hydrogenated at 24° C. and under atmospheric pressure in an apparatus as depicted in FIG. 3. As catalyst palladium on carbon black containing 3% Pd was used in an amount corresponding to 100 ppm palladium. The solvent was acetone and the ratio of rape seed oil to acetone was 1:4.5. The liquid contained 0.05 M tetraethyl ammonium perchlorate (TEAP) as the electrolyte.

The results are summarized in Table 10.

TABLE 10

| Fatty acid | Composition of starting oil (%) | Composition of hydrogenated product (%) no external potential applied[1] | with an external potential applied of −0.95V vs SCE |
|---|---|---|---|
| C 18:3 | 10 | 2 | 2 |
| C 18:2 | 19 | 15 | 19 |
| C 18:1 | 59 | 70 | 66 |
| C 18:0 | 2 | 3 | 2 |
| C 16:0 | 5 | 5 | 5 |
| Total trans content (%) | <1 | 11 | 5 |
| Hydrogenation time (min.) | — | 15 | 45 |

[1]As catalyst 1.4% palladium powder was used.

EXAMPLE IV

Top white tallow was hydrogenated at 40° C. and under atmospheric pressure in an apparatus as depicted in FIG. 3. As catalyst 0.3% palladium powder was used. Acetone containing 0.05 M TEAP as electrolyte was the liquid which was used in a ratio of oil to liquid of 1:4.5.

The results are summarized in Table 11.

TABLE 11

| Fatty acid | Composition of starting oil (%) | Composition of hydrogenated product (%) no external potential applied | with an external potential applied of −0.95V vs SCE |
|---|---|---|---|
| C 18:3 | 0.2 | — | — |
| C 18:2 | 3 | 2 | 2 |
| C 18:1 | 41 | 43 | 44 |
| C 18:0 | 15 | 15 | 15 |
| C 16:0 | 24 | 24 | 24 |
| Total trans content (%) | 3 | 9 | 5 |
| Hydrogenation time (min.) | — | 36 | 66 |
| Iodine value | 49 | 46 | 46 |

Though the influence on the selectivity seems rather low, the amount of trans-isomers formed is reduced drastically, which has a marked influence on the dilatation values of the oil, as is shown in Table 12.

TABLE 12

| Dilatation of | $D_{15}$ | $D_{20}$ | $D_{25}$ | $D_{30}$ | $D_{35}$ | $D_{40}$ | $D_{45}$ |
|---|---|---|---|---|---|---|---|
| Starting oil | 580 | 505 | 370 | 255 | 165 | 60 | 0 |
| Hydrogenated without a potential applied | 820 | 675 | 505 | 350 | 215 | 85 | 0 |
| Hydrogenated with an external potential applied | 665 | 570 | 420 | 290 | 180 | 65 | 0 |

EXAMPLE XV

Palm oil was hydrogenated at 40° C. and atmospheric pressure in an apparatus as depicted in FIG. 3. As a catalyst 0.5% palladium powder was used. Acetone containing 0.05 M TEAP as the electrolyte was the liquid, which was used in a ratio of oil to liquid of 1:4.5. The results are summarized in Table 13.

TABLE 13

| Fatty acid | Composition of starting oil (%) | Composition of hydrogenated product (%): no external potential applied | Composition of hydrogenated product (%): with an external potential applied of −0.95V vs SCE |
|---|---|---|---|
| C 18:3 | 0.3 | — | — |
| C 18:2 | 10.5 | 2.5 | 2.5 |
| C 18:1 | 38.7 | 46 | 46.5 |
| C 18:0 | 4.7 | 5.7 | 5.2 |
| C 16:0 | 43.6 | 43.6 | 43.4 |
| Total trans content (%) | <1 | 6 | 3 |
| Hydrogenation time (min.) | — | 52 | 71 |
| Iodine value | 53.6 | 44 | 45 |

EXAMPLE XVI 90 g fish oil were hydrogenated at 24° C. in an apparatus according to FIG. 3. 1.5 g of a catalyst consisting of 3% palladium on carbon were used. Acetone was the liquid, which was used in an oil:liquid ratio of 1:4.5, and which contained 0.05 M TEAP as the electrolyte. Hydrogenation was continued until the hydrogen consumption was 70 ml/g. The results are summarized in Table 14 and compared with the results obtained when the fish oil was hydrogenated in a conventional way with the aid of a nickel catalyst in two stages at 150° C. and 180° C. and at a pressure of 4 atm.

TABLE 14

| | Starting oil | Conventionally hydrogenated oil using a nickel catalyst | With an external potential applied of −0.95V |
|---|---|---|---|
| Iodine value | 163 | 75 | 75 |
| Total trans content (%) | <1 | 42 | 37 |
| Dilatation: | | | |
| $D_{15}$ | | 935 | 555 |
| $D_{20}$ | | 730 | 400 |
| $D_{25}$ | | 565 | 225 |
| $D_{30}$ | | 330 | 65 |
| $D_{35}$ | | 100 | 0 |
| $D_{40}$ | | 10 | 0 |

Without an externally applied potential 49% of trans isomers were formed at an iodine value of 75, using a palladium on carbon catalyst and working in acetone.

EXAMPLES XVII AND XVIII 100 ml palmoil were dissolved in 450 ml acetone containing 0.05 M TEAP. The solution was hydrogenated at 40° C. at a pressure of 78 cm Hg in an apparatus as depicted in FIG. 3. In Example XVII the catalyst used was 0.5 g palladium powder. In Example XVIII 0.225 g of a palladium-on-carbon catalyst containing 3% Pd were used.

The results of the trials are summarized in Table 15.

TABLE 15

| | Starting oil | Without an external potential applied | With an external potential applied of −0.95V vs SCE | With an external potential applied of −0.95V vs SCE |
|---|---|---|---|---|
| Catalyst | | 0.5 g Pd | 0.5 g Pd | 0.225 g 3% Pd/C |
| Hydrogen consumption (ml) | | 860 | 789 | 781 |
| Hydrogenation time (min.) | | 21 | 73 | 56 |
| Iodine value | 53.5 | 45.0 | 45.0 | 45.0 |
| C 16:0 (%) | 42.2 | 42.0 | 41.8 | 42.5 |
| C 18:0 (%) | 6.0 | 7.7 | 6.4 | 6.6 |
| C 18:1 (%) | 38.0 | 46.9 | 46.9 | 47.7 |
| C 18:2 (%) | 12.5 | 2.0 | 2.2 | 2.0 |
| Total trans content (%) | <1 | 9 | 6 | 6 |
| Extinction | | | | |
| E 232 | 2.268 | 2.101 | 2.003 | |
| E 268 | 1.518 | 0.411 | 0.309 | |
| Dilatation | | | | |
| $D_{15}$ | 750 | 1280 | 1110 | |
| $D_{20}$ | 595 | 1130 | 925 | |
| $D_{25}$ | 405 | 860 | 665 | |
| $D_{30}$ | 265 | 560 | 425 | |
| $D_{35}$ | 155 | 360 | 255 | |
| $D_{40}$ | 25 | 140 | 80 | |
| $D_{45}$ | 0 | 0 | 10 | |
| $D_{50}$ | 0 | 0 | 10 | |
| $D_{55}$ | 0 | 0 | 0 | |

EXAMPLE XIX 100 g. trans, trans, cis-1,5,9-cyclododecatriene (CDT) were dissolved in 450 ml acetone containing 0.05 M TEAP Hydrogenation was carried out in an apparatus as depicted in FIG. 3, at a temperature of 24° C. and a pressure of 78 cm Hg with 3% Pd/C as catalyst.

Without applying an external potential 42.6 l of $H_2$ were taken up in 6 hours; with an externally applied potential of −0.95 V vs SCE only 19.5 l $H_2$ were taken up in 6 hours. The latter hydrogenation was stopped after 13.5 hours when 26.6 l $H_2$ had been taken up, because hydrogen consumption had practically ceased.

In both experiments the trans, trans, cis-1,5,9-CTD was converted at the same rate. The externally applied potential reduced the amount of trans,trans,trans-CDT. Also less cyclododecane was formed. During the reaction with the externally applied potential the amount of dienes in the reaction mixture is always higher, compared with the run without an externally applied potential.

Figure 4A:
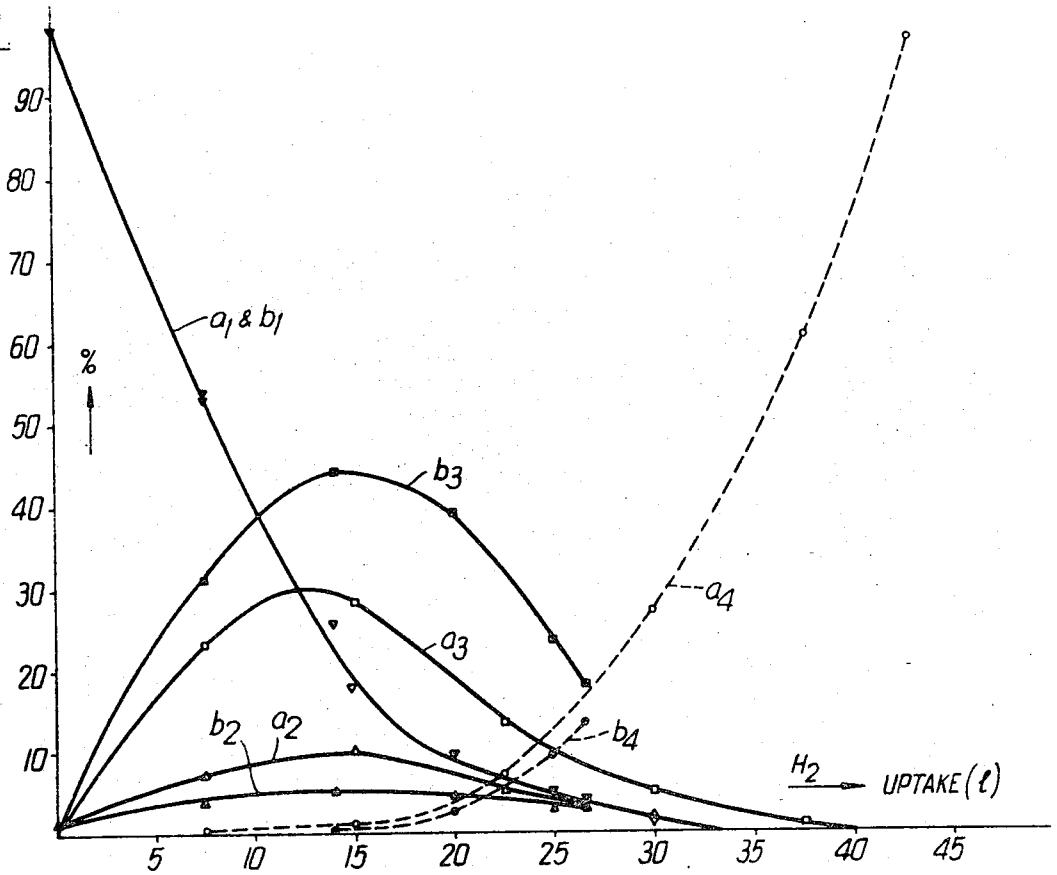
Figure 4B:
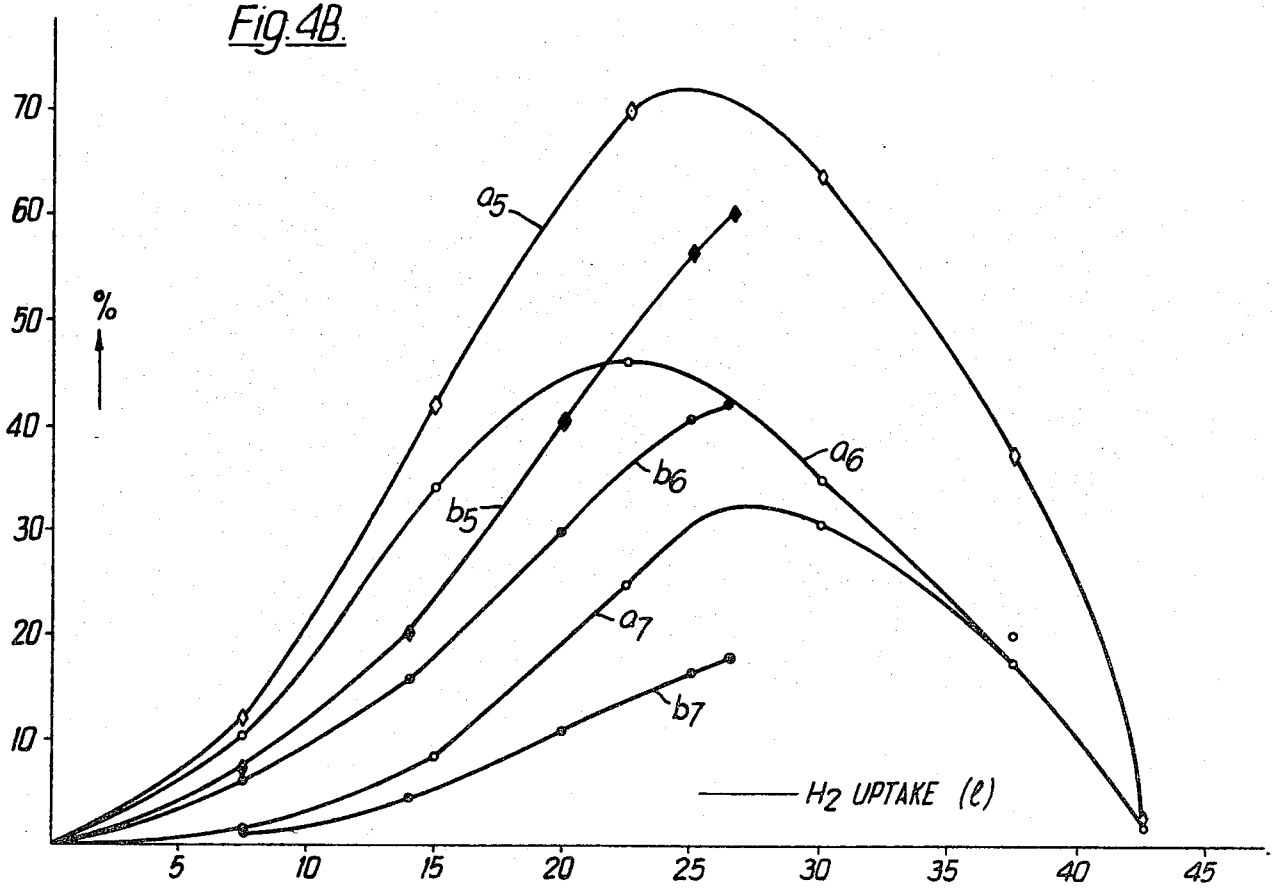

The course of hydrogenation is further shown in FIGS. 4A and 4B. The different curves give the concentration of the components of the system as function of the hydrogen consumption. The curves marked "a" show the concentration of a particular component when no external potential is applied. The correspondingly numbered curves marked "b" give the concentrations of the same component during hydrogenation with an externally applied potential of −0.95 V vs SCE. For convenience the designations of the different curves are summarized in Table 16.

TABLE 16

| Component | without an external potential applied | with an internal potential applied of −0.95V vs SCE | Remarks |
|---|---|---|---|
| cis, trans, trans-triene | a1[1] | b1[1] | |
| trans, trans, trans-triene | a2 | b2 | FIG. 4A |
| diene | a3 | b3 | |
| cyclo dodecane | a4 | b4 | |
| total mono-ene | a5 | b5 | |
| cis mono-ene | a6 | b6 | FIG. 4B |
| trans mono-ene | a7 | b7 | |

[1]The curves a1 and b1 coincide.

EXAMPLES XX–XXIV

In an apparatus according to FIG. 3 soyabean oil was hydrogenated. In Example XX the potential was applied to a mixture of liquid, electrolyte and the catalyst in a hydrogen atmosphere, and after equilibration the hydrogenation was started by injecting the oil into the apparatus. In Examples XXI to XXIV the catalyst, liquid, electrolyte and oil were added to the reaction vessel, then a nitrogen atmosphere was applied above the system and after equilibration the hydrogenation was started by replacing nitrogen by hydrogen. The further conditions of hydrogenation and the results are summarized in Table 17.

TABLE 17

| Example | Soyabean oil | Electrolyte solution | Atmosphere in which potential is applied | External potential applied (V vs SCE) | Hydrogenation time (min.) | $H_2$—consumption (ml) | Total trans content (%) | C 16:0 (%) | C 18:0 (%) | C 18:1 (%) | C 18:2 (%) | C 18:3 (%) |
|---|---|---|---|---|---|---|---|---|---|---|---|---|
| | starting soyabean oil→ | | | | | | <1 | 11.0 | 3.6 | 21.9 | 54.8 | 7.1* |
| XX | 100 ml | 450 ml 0.05 M TEAP-Acetone | $H_2$ | −0.95 | 40 | 1450 | 8 | 11.1 | 3.9 | 35.9 | 45.0 | 2.0* |
| XXII | 100 ml | 500 ml 0.05 M TEAP-Acetone | $N_2$ | −0.95 | 57 | 1500 | 7 | 10.8 | 3.8 | 35.0 | 46.9 | 2.0* |
| XXII | 200 ml | 300 ml 0.05 M TEAP-Acetone | $N_2$ | −0.95 | 88 | 3000 | 7 | 10.8 | 3.8 | 35.4 | 46.2 | 2.0* |
| XXIII | 200 ml | 300 ml 0.05 M TEAP-Acetone | $N_2$ | −1.2 | 189 | 2350 | 7 | 10.8 | 3.7 | 31.6 | 50.3 | 2.0* |
| XXIV | 200 ml | 300 ml 0.05 M TEAP-Acetone | $N_2$ | −1.5 | 245 | 2300 | 6 | 10.8 | 3.8 | 30.6 | 51.4 | 2.0* |

*C 18:3 contained 0.4% of isomers designated as 6,9,12-octadeca-trienoic acid
In all the Examples 1.25 palladium powder was used as the catalyst.

These experiments show that the starting procedure as described in Examples XXI to XXIV (in which the potential is applied under a nitrogen atmosphere) leads to a higher selectivity of the hydrogenation reaction. Especially $S_{II}$ is improved. The Table further shows that applying a more negative potential improves the selectivity and also decreases the trans content of the hydrogenation product.

EXAMPLE XXV

In an apparatus as shown in FIG. 3, 100 ml soyabean oil dissolved in 450 ml acetone containing 0.05 M TEAP were hydrogenated with 1.25 g palladium powder as the catalyst. In this case the potential on the catalyst was not applied by a potentiostat, but a potential was applied between the working electrode and the counterelectrode with the aid of a direct current power supply, the voltage of which was raised until the potential between the working electrode and the reference electrode (S.C.E.) was −1.5 V. During application of said potential a nitrogen atmosphere was maintained in the apparatus; after half an hour the power supply was switched off and hydrogenation was started by replacing nitrogen by hydrogen. During hydrogenation the potential on the working electrode was measured. This experiment was carried out at a temperature of 24° C. and at a pressure of 78 cm Hg.

The results of this experiment are stated in Table 18.

TABLE 18

| Hydrogenation time (min) | $H_2$—uptake (ml) | Potential (V vs SCE) | Trans (%) | Fatty acid composition (%) C 16:0 | C 18:0 | C 18:1 | C 18:2 | C 18:3 |
|---|---|---|---|---|---|---|---|---|
| | starting oil | | <1 | 10.8 | 3.55 | 20.7 | 55.6 | 7.5* |
| 0 | 0 | −1.14 | | | | | | |
| 83 | 500 | −1.03 | 2 | 11.0 | 3.6 | 24.4 | 54.9 | 4.5* |
| 197 | 1150 | −1.02 | 5 | 10.9 | 3.7 | 30.2 | 51.6 | 2.0* |
| 237 | 1500 | −0.98 | 6 | 10.9 | 3.7 | 34.0 | 48.6 | 1.2* |

TABLE 18-continued

| Hydrogenation time (min) | $H_2$—uptake (ml) | Potential (V vs SCE) | Trans (%) | Fatty acid composition (%) | | | | |
|---|---|---|---|---|---|---|---|---|
| | | | | C 16:0 | C 18:0 | C 18:1 | C 18:2 | C 18:3 |
| 299 | 2000 | −0.93 | 7 | 10.8 | 3.7 | 39.9 | 43.6 | 0.7* |

*C 18:3 contains 0.4% of isomers designated 6,9,12-octadeca-trienic acid.

This Example shows that the potential applied to the catalyst after switching off the power supply at first rapidly decreases from −1.5 V vs SCE to about −1 V SCE, which potential only were slowly decreases in the course of hydrogenation. The selectivity of the hydrogenation is very good.

EXAMPLE XXVI

In an apparatus according to FIG. 3 soyabean oil was hydrogenated. The apparatus was charged with 100 ml oil, 450 ml acetone containing 0.05 M TEAP and catalyst. The potential was not applied by a potentiostat, but a potential was applied between the working electrode and the counterelectrode with the aid of a direct current power supply (D050-10 Delta Elektronika), the voltage of which was raised until the potential between the working electrode and the reference electrode (SCE) was −1.5 V. During application of said potential a nitrogen atmosphere was maintained in the apparatus. At the start of the hydrogenation nitrogen was replaced by hydrogen. During hydrogenation the potential of the system was kept on −1.5 V vs. SCE with the aid of the DC power supply.

The hydrogenations were carried out at 24° C. and under atmospheric pressure.

Several catalysts have been tested. Table 19 illustrates the results.

TABLE 19

| Catalyst (load) | imposed potential (V vs SCE) | hydr. time (min) | trans (%) | fatty acid comp. (%) | | | |
|---|---|---|---|---|---|---|---|
| | | | | C 18:0 | C 18:1 | C 18:2 | C 18:3* |
| starting oil | | — | <1 | 3.6 | 20.7 | 55.6 | 7.5 |
| 5% Rh/C (200 mg Rh/kg oil) | no | 150 | 18 | 14.1 | 38.4 | 32.5 | 2.0 |
| 5% Rh/C (500 mg Rh/kg oil) | −1.5 | 119 | 10 | 4.4 | 37.4 | 42.7 | 2.0 |
| 5% Ru/C (1200 mg Ru/kg oil) | no | 600 | 31 | 16.4 | 36.2 | 31.7 | 2.0 |
| 5% Ru/C (3000 mg Ru/kg oil) | 31 1.5 | 53 | 32 | 5.2 | 38.2 | 39.9 | 2.0 |
| 5% Pt/C (100 mg Pt/kg oil) | no | 241 | 4 | 17.7 | 39.4 | 28.1 | 2.0 |
| 5% Pt/C (600 mg Pt/kg oil) | −1.5 | 112 | 2 | 5.6 | 37.0 | 42.6 | 2.0 |
| Raney Ni (0.8% Ni) | no | 296 | 12 | 6.3 | 43.9 | 35.6 | 2.0 |
| Raney Ni (3% Ni) | −1.5 | 163 | 7 | 3.8 | 36.5 | 45.0 | 2.0 |
| 5% Pd/C (50 mg Pd/kg oil) | no | 63 | 16 | 5.1 | 45.3 | 34.4 | 2.0 |
| 3% Pd/C (150 mg Pd/kg oil) | −1.5 | 14 | 5 | 3.7 | 27.5 | 53.8 | 2.0 |

*C 18:3 contained 0.4% of isomers designated as 6,9,12-octadeca-trienoic acid. In the experiment with Rh/C 0.2–0.3% conjugated diene was formed. The catalyst Ru/C formed about 1.5% conjugated diene during hydrogenations.

It is shown that the saturated fatty acid content is decreased and the linoleic acid content increased with an imposed potential.

EXAMPLE XXVII

The potential was applied to the catalyst with a DC power supply in an apparatus as depicted in FIG. 2.

However, the saturated calomel electrode was contacted with the cathode compartment (working electrode compartment) through a ceramic diaphragm and a salt bridge i.e. the same contact as mentioned in Example XII.

The apparatus was loaded with acetone containing 0.05 M TEAP and catalyst.

Under a nitrogen atmosphere a potential of up to −1.4 V vs. SCE was imposed on this system with the aid of a DC power supply (D 050-10 Delta Elektronika) for 45 minutes. An apparatus, as mentioned in Example XII FIG. 3, was used as hydrogenation reactor and was filled with 100 ml soyabean oil and 450 ml acetone.

The acetone in the hydrogenation reactor did not contain an electrolyte.

The contents of the cathode compartment of the apparatus as shown in FIG. 2, being about 30 ml, were transferred to the working electrode compartment of the hydrogenation reactor. This reactor was not connected with a potentiostat or a DC power supply. In the hydrogenation reactor the potential between working electrode and reference electrode (SCE) was measured with a vacuum tube voltmeter.

Table 20 summarizes the results.

Catalyst: 1 gram palladium powder.

Temperature: 24° C. Atmospheric pressure.

TABLE 20

| time (min.) | $H_2$—uptake (ml) | potential (V. vs SCE) | trans (%) | C 18:0 (%) | C 18:1 (%) | C 18:2 (%) | C 18:3* (%) |
|---|---|---|---|---|---|---|---|
| starting soyabean oil | | | <1 | 3.6 | 20.7 | 55.6 | 7.5 |
| 150 | 500 | −1.03 | 3 | 3.7 | 24.3 | 54.1 | 5.1 |
| 270 | 1000 | −1.02 | 4 | 3.7 | 27.7 | 52.9 | 3.2 |
| 352 | 1400 | −1.00 | 5 | 3.7 | 31.0 | 50.8 | 2.0 |
| 398 | 2000 | −0.97 | 7 | 3.8 | 38.5 | 44.0 | 1.1 |

*C 18:3 contained 0.4% of isomers designated as 6,9,12-octadeca-trienoic acid

EXAMPLE XXVIII

Example XXVII was repeated using 3% Pd-on-carbon as the catalyst (catalyst load 25 mg Pd/kg oil). Under a nitrogen atmosphere a potential of up to −1.3 V vs SCE was imposed on the catalyst for 60 minutes in an apparatus as shown in FIG. 2.

The contents of the cathode compartment were transferred to a 3 l glass reactor, with stirrer, and filled with 650 ml soyabean oil and 650 ml acetone. After 100 minutes' hydrogenation the soyabean oil had the following analytical characteristics.

Iodine value: 120.9

Trans content: 5%

Palladium concentration: 0.2 mg Pd/kg oil after filtration

Fatty acid composition (%):

C 16:0=10.5, C 18:0=3.8, C 18:1=31.6, C 18:2=50.8, C 18:3=1.9.

The hydrogenated oil was refined and evaluated on taste and keepability.

After refining the palladium content of the oil amounted to 0.03 mg Pd/kg oil.

After 10 weeks the oil still has a fairly good taste.

EXAMPLE XXIX

Example XXVII was repeated.

However, the apparatus as depicted in FIG. 2 was filled with catalyst and a liquid containing the electrolytes mentioned in Table 21.

A potential of up to −1.0 V vs SCE was imposed on these systems under nitrogen with a DC power supply.

The hydrogenation was carried out in an apparatus as shown in FIG. 3, filled with 100 ml soyabean oil and 450 ml acetone.

Temperature 24° C. Atmospheric pressure.

Table 21 shows the results.

When methanol was the liquid for the electrolyte (in the apparatus as shown in FIG. 2) during application of the potential, methyl esters were detected in the hydrogenated products.

TABLE 21

| electrolyte solution in the apparatus as depicted in FIG. 2 | catalyst (load mg Pd/kg oil) | hydrogenation time (min) | potentials vs SCE during hydrogenation: after 500 ml $H_2$—uptake | potentials vs SCE during hydrogenation: at C 18 = 2% | trans (%) | fatty acid composition (%): C 16:0 | C 18:0 | C 18:1 | C 18:2 | C 18:3* |
|---|---|---|---|---|---|---|---|---|---|---|
| | starting oil | | | | <1 | 10.5 | 3,9 | 21.5 | 53.9 | 8.5 |
| 0.02 M sodium dodecyl-6-sulphonate in acetone (containing 5% water) | 5% Pd/C (200) | 46 | −0.62V | −0.83V | 8 | 10.6 | 4.4 | 40.0 | 41.5 | 2.0 |
| 0.05 M tetraethylammonium-paratoluene sulphonate in acetone | 5% Pd/C (200) | 40 | −0.72V | −0.83V | 7 | 10.5 | 4.1 | 35.4 | 46.6 | 2.0 |
| 0.03 M tetraethylammonium-bromide in acetone | 3% Pd/C (400) | 35 | −0.86V | −0.87V | 7 | 10.5 | 4.0 | 33.0 | 49.2 | 2.0 |
| 0.05 M tetramethylammonium-acetate in methanol | 3% Pd/C (200) | 24 | −0.67V | −0.99V | 5 | 10.5 | 3.9 | 31.2 | 51.3 | 2.0 |
| 0.05 M sodium methanolate in methanol | 3% Pd/C (200) | 48 | −0.63V | −0.90V | 7 | 10.5 | 3.9 | 34.7 | 47.3 | 2.0 |
| 0.05 M tetraethylammonium phosphate in acetone | 3% Pd/C (500) | 29 | −0.64V | −0.72V | 7 | 10.4 | 4.1 | 35.4 | 46.4 | 2.0 |
| 0.05 M sodium acetate in methanol | 5% Pd/C (700) | 350 | −0.96V | −0.90V* | 7 | 10.6 | 3.9 | 27.6 | 52.8 | 3.6 |
| 0.1 M sodium hydroxide in methanol (containing 5% water) | 5% Pd/C (700) | 330 | −0.96V | −0.96V* | 6 | 10.6 | 3.9 | 26.6 | 53.3 | 3.6 |

*potential vs SCE at C 18:3 = 3.6%

EXAMPLE XXX

Example XXIX was repeated.

The apparatus as depicted in FIG. 2 was loaded with the catalyst (3% Pd on carbon) and glycerol containing 10 M $CH_3ONa$.

A potential of up to −0.93 V vs SCE was imposed at a temperature of 45° C. under a nitrogen atmosphere for 3 hours. The hydrogenation was carried out in an apparatus as shown in FIG. 3, charged with 100 ml soyabean oil and 450 ml propanol-1.

Temperature 40° C. Atmospheric pressure.

Catalyst load: 2.4 g 3% Pd on carbon

Table 22 shows the results.

TABLE 22

| | hydrogenation time (min) | trans | fatty acid composition (%): C 16:0 | C 18:0 | C 18:1 | C 18:2 | C 18:3 |
|---|---|---|---|---|---|---|---|
| starting oil | | <1 | 10.5 | 3.9 | 21.5 | 53.9 | 8.5* |
| with applying a potential | 46 | 8 | 10.4 | 3.9 | 28.2 | 53.8 | 2.0** |

*C 18:3 contained 0.4% of isomers designated as 6,9,12-octadeca-trienoic acid
**C 18:3 contained 1.4% 6,9,12-octadeca-trienoic acid and other isomers

EXAMPLE XXXI

Example XXVII was repeated using palladium on ion-exchange resin as catalyst.

The catalyst was prepared by adsorbing palladium-chloride on the ion-exchange resin Amberlyst A27 in diluted acetic acid. Subsequently the catalyst was reduced with $NaBH_4$. The resin contained 14.2% palladium.

A potential of up to −1.4 V vs SCE was applied to the catalyst in acetone containing 0.05 M TEAP for 135 min. The hydrogenation reactor was charged with 100 ml soyabean oil and 450 ml acetone.

Temperature 24° C. Atmospheric pressure.

130 mg catalyst were used. Table 23 shows the results.

TABLE 23

| | hydrogenation time (min.) | trans % | fatty acid composition (mole %): C 16:0 | C 18:0 | C 18:1 | C 18:2 | C 18:3 |
|---|---|---|---|---|---|---|---|
| starting oil | | <1 | 10.5 | 3.9 | 21.5 | 53.9 | 8.5 |
| hydr. oil | 191 | 4 | 10.4 | 4.0 | 30.5 | 52.0 | 2.0 |

EXAMPLE XXXII

Example XXXI was repeated using 2% palladium on silica as a catalyst (catalyst load: 100 mg Pd/kg oil) and applying a potential of up to −1.25 V vs SCE for 60 minutes.

Table 24 shows the results.

TABLE 24

| | hydrogenation time (min.) | trans (%) | fatty acid composition (%) C 16:0 | C 18:0 | C 18:1 | C 18:2 | C 18:3 |
|---|---|---|---|---|---|---|---|
| starting oil | | <1 | 10.5 | 3.9 | 21.5 | 53.9 | 8.5 |
| hydr. oil | 133 | 6 | 10.5 | 4.0 | 33.1 | 48.8 | 2.0 |

EXAMPLE XXXIII

The potential was applied to the catalyst according to Example XXVII in the apparatus as shown in FIG. 2. A potential of −1.3 V vs SCE was applied to the catalyst 5% Pd/C and acetone containing 0.05 M TEAP.

The contents of the cathode compartment were transferred to a 1 l. Parr autoclave filled with 200 ml soyabean oil and 400 ml acetone.

After that, the contents of the autoclave were warmed up to 60° C. under nitrogen. At the start of the hydrogenation nitrogen was replaced by hydrogen.

In a second experiment, without applying a potential, 30 ml 0.05 M TEAP in acetone were added to the contents of the autoclave.

The hydrogenations were carried out at a temperature of 60° C. and a pressure of 3 atm.

Table 25 illustrates the results:

TABLE 25

| potential | catalyst load (mgPd/kg oil) | hydrogenation time (min.) | trans (%) | fatty acid composition (%) C 16:0 | C 18:0 | C 18:1 | C 18:2 | C 18:3 |
|---|---|---|---|---|---|---|---|---|
| with applying a potential | starting oil | | <1 | 10.5 | 3.9 | 21.5 | 53.9 | 8.5 |
| without applying a potential | 200 | 48 | 5 | 10.5 | 4.0 | 32.3 | 49.7 | 2.0 |
| | 25 | 21 | 16 | 10.4 | 6.3 | 49.1 | 31.1 | 2.0 |

EXAMPLE XXXIV

Example XXXIII was repeated.

The apparatus as shown in FIG. 2 was filled with acetone containing 0.05 M TEAP and 1.8 grams 5% Pd on carbon catalyst. A potential of up to −1.0 V vs SCE was imposed for 85 minutes. Hydrogenation was carried out in a 1 l Parr autoclave filled with 500 ml soyabean oil.

Temperature: 100° C. Pressure: 4 atm.

The results are shown in the following table:

TABLE 26

| hydrogenation time (min.) | trans (%) | fatty acid composition (%) C 16:0 | C 18:0 | C 18:1 | C 18:2 | C 18:3 |
|---|---|---|---|---|---|---|
| starting oil | <1 | 10.5 | 3.9 | 21.5 | 53.9 | 8.5 |
| 13 | 13 | 10.5 | 4.0 | 35.5 | 46.5 | 2.0 |

EXAMPLE XXXV

Example XXVII was repeated.

The apparatus as depicted in FIG. 2 was filled with acetone containing 0.05 M TEAP and 450 mg 3% palladium-on-carbon catalyst. A potential of up to −1.4 V vs SCE was imposed. At the start of the hydrogenation the contents of the cathode compartment were transferred to the working electrode compartment of the hydrogenation reactor.

The hydrogenation was performed in an apparatus as shown in FIG. 3, filled with 100 ml linseed oil and 450 ml acetone.

The hydrogenation was carried out at 24° C. and under atmospheric pressure.

The apparatus as shown in FIG. 2 was again filled with acetone containing 0.05 M TEAP and 300 mg 3% palladium-on-carbon catalyst, and a potential of up to −1.4 V vs SCE was imposed. After the linseed oil had taken up 4000 ml $H_2$, the contents of the cathode compartment of the apparatus as shown in FIG. 2 were again transferred to the hydrogenation reactor.

The results are summarized in the Table 27.

TABLE 27

| | Starting oil | $H_2$—uptake 2500 ml | 5000 ml | 7000 ml | 8000 ml |
|---|---|---|---|---|---|
| C 16:0 (%) | 5.7 | 5.7 | 5.7 | 5.7 | 5.7 |
| C 18:0 (%) | 3.5 | 3.5 | 3.5 | 3.7 | 4.0 |
| C 18:1 (%) | 15.4 | 19.4 | 27.0 | 40.7 | 52.0 |
| C 18:2 (%) | 16.1 | 38.3 | 51.0 | 48.4 | 37.2 |
| C 18:3 (%) | 58.9 | 32.8 | 12.2 | 1.1 | 0.0 |
| trans. (%) | <1 | 10 | 19 | 25 | 29 |

We claim:

1. Process for the selective hydrogenation of a polyunsaturated organic compound containing more than one double bond in a carbon chain or ring comprising hydrogenating said compound with molecular hydrogen in the presence of a metallic hydrogenation catalyst and applying an external electric potential differing from the equilibrium potential and having a value of between 0 V and −3 V as measured against a saturated calomel electrode to the catalyst while it is in contact with a liquid, which liquid contains an electrolyte.

2. Process according to claim 1, in which the external electric potential is applied during the whole of the hydrogenation.

3. Process according to claim 1, in which the external electric potential is switched off after the hydrogenation reaction is started.

4. Process according to claim 1, in which the external potential is applied to the catalyst in a vessel separated from the hydrogenation reactor.

5. Process according to claim 1, in which the liquid containing an electrolyte and catalyst are brought into a reaction vessel under a hydrogen atmosphere, an external potential is applied to the catalyst and thereafter the compound to be hydrogenated is brought into the reaction vessel.

6. Process according to claim 1, in which the liquid containing an electrolyte, catalyst and the compound to be hydrogenated are brought into a reaction vessel under an inert atmosphere, an external potential is applied to the catalyst, and thereafter the inert atmosphere is replaced by hydrogen.

7. Process according to claim 4, in which liquid containing an electrolyte and the catalyst are brought into the separate vessel under an inert atmosphere, an external electric potential is applied to the catalyst, and the contents of said vessel are brought into the hydrogenation reactor already containing the compound to be hydrogenated.

8. Process according to claim 1 in which as the catalyst a metal supported on a carrier is used.

9. Process according to claim 8, in which as the metal palladium platinum, rhodium, ruthenium and/or nickel is used.

10. Process according to claim 8, in which the carrier consists of a metal, carbon black, silica or an ion-exchange resin.

11. Process according to claim 1, in which the external potential is applied to the catalyst by stirring a suspension of the catalyst to contact the catalyst particles with an electrode to which an electric potential is applied.

12. Process according to claim 1, in which an external potential of between 0 V to −3 V as measured against a saturated calomel electrode, is applied.

13. Process according to claim 1, in which as the liquid an alcohol or a ketone is used.

14. Process according to claim 1, in which as the liquid water, methanol, ethanol, propanol, glycerol, acetone, methyl cellosolve, acetonitrile, hexane, benzene or a mixture thereof is used.

15. Process according to claim 1, in which the ratio by weight of the liquid to the compound to be hydrogenated is between 1:1 to 20:1.

16. Process according to claim 1, in which as the electrolyte a quaternary ammonium salt is used.

17. Process according to claim 1, in which the electrolyte is used in a concentration of between 0.001 to 0.1 mol per liter.

18. Process according to claim 1, in which the hydrogenation is carried out at a temperature of between −20° C. to 200° C.

19. Process according to claim 1, in which the hydrogenation is carried out under a pressure of between 1 to 25 atm.

20. Process according to claim 1, in which an edible triglyceride oil is hydrogenated.

21. The process of claim 1 wherein the catalyst is selected from the group consisting of palladium, platinum, rhodium, ruthenium and nickel.

22. The process of claim 1 wherein the electrolyte is selected from the group consisting of quaternary ammonium salts, sodium dodecyl-6-sulfonate, sodium acetate, sodium hydroxide and sodium methanolate.

23. The process of claim 1 wherein the electrolyte is selected from the group consisting tetraethylammonium perchlorate, tetrabutylammonium perchlorate, tetraethylammonium phosphate, tetraethylammonium bromide, tetraethylammonium paratoluenesulfonate, and tetramethylammonium acetate.

* * * * *